US006964337B2

(12) United States Patent
Engle

(10) Patent No.: US 6,964,337 B2
(45) Date of Patent: Nov. 15, 2005

(54) GARDENING TOOL TRANSPORT AND STORAGE DEVICE

(76) Inventor: Patrick A. Engle, 21724 Cable Ave., Winsted, MN (US) 55395

( * ) Notice: Subject to any disclaimer, the term of this patent is extended or adjusted under 35 U.S.C. 154(b) by 0 days.

(21) Appl. No.: 10/620,660

(22) Filed: Jul. 16, 2003

(65) Prior Publication Data

US 2004/0084339 A1 May 6, 2004

Related U.S. Application Data

(60) Provisional application No. 60/396,202, filed on Jul. 16, 2002.

(51) Int. Cl.[7] ..... A45C 11/26

(52) U.S. Cl. ..... 206/374; 206/349; 206/207; 206/523; 220/756; 220/759; 294/52

(58) Field of Search ..... 206/349, 362, 206/372–375, 207, 523, 15.2, 15.3, 592, 206/317, 524.3; 294/51, 52, 57, 58; 220/697, 220/756, 759, 735; 190/102

(56) References Cited

U.S. PATENT DOCUMENTS

| | | | | | |
|---|---|---|---|---|---|
| 978,358 | A * | 12/1910 | Colby | 206/373 |
| 1,094,009 | A * | 4/1914 | Parkhurst | 206/373 |
| 1,632,172 | A * | 6/1927 | Clifford | 206/374 |
| 2,554,680 | A * | 5/1951 | Morris et al. | 206/374 |
| 2,639,454 | A * | 5/1953 | Dory | 206/373 |
| 2,914,377 | A * | 11/1959 | Bull | 206/205 |
| 3,642,998 | A * | 2/1972 | Jennings | 206/207 |
| 3,895,710 | A * | 7/1975 | Harvell | 206/349 |
| 4,224,786 | A | 9/1980 | Langlie et al. | |
| 4,593,520 | A | 6/1986 | Krizman | |
| 4,790,585 | A | 12/1988 | Vernon et al. | |
| 5,603,584 | A | 2/1997 | Schuele | |
| 5,674,022 | A | 10/1997 | Liao | |
| 5,738,214 | A * | 4/1998 | Wyss | 206/373 |
| 5,970,663 | A | 10/1999 | McDonough | |
| 5,974,775 | A | 11/1999 | Niehuss | |
| 6,213,314 | B1 | 4/2001 | Beemer | |
| 6,254,251 | B1 | 7/2001 | Washington | |
| 6,264,030 | B1 | 7/2001 | Tsou | |
| 6,267,240 | B1 | 7/2001 | Callaway | |
| 6,439,630 | B1 * | 8/2002 | Eatmon | 294/51 |
| 2003/0037390 | A1 * | 2/2003 | Leblanc | 220/735 |

* cited by examiner

*Primary Examiner*—Mickey Yu
*Assistant Examiner*—J. Gregory Pickett
(74) *Attorney, Agent, or Firm*—Dorsey & Whitney LLP

(57) ABSTRACT

A case for storing and carrying gardening tools including gardening tool heads that can have be interchangeably connected to a handle. The handle can be stored along with the gardening tool heads in the suitcase, or can be used as a handle for the suitcase. The tool heads and the tool handle connect via various suitable connection methods.

16 Claims, 5 Drawing Sheets

GARDENING TOOL TRANSPORT AND STORAGE DEVICE

CROSS-REFERENCE TO RELATED APPLICATION

This application claims priority to U.S. Provisional Application No. 60/396,202, filed on Jul. 16, 2002, the contents of which are incorporated herein by reference.

FIELD OF THE INVENTION

The present invention relates to storage devices, particularly to gardening tool storage devices and gardening tools. More specifically, the present invention relates to a case for storing and carrying gardening tools and gardening tool heads and handle(s) wherein the tool heads are interchangeably mountable on the handles.

BACKGROUND OF THE INVENTION

Gardening and relatively light duty landscaping activities are popular hobbies with many homeowners. Such work generally involves the use of small trowels and other relatively small hand tools and accessories, such as claws and row markers, and also often requires larger, longer handled tools, such as shovels, rakes, hoes, edgers, etc., depending upon the specific task.

It would be a benefit to these individuals to have a system to efficiently transport these items to the work area of the yard or garden. In addition, because the items should often be transported back to the garage or shed in which they are kept, it would be a benefit, if the transport system could also be used as a storage system.

Current devices for storing garden tools are racks and carts. These help somewhat to alleviate the problem of storing a plurality of tools and accessories, but they still take up a lot of room, and can be burdensome to transport, it they can be transported at all. This problem becomes even more acute when many long-handled tools such as rakes and hoes are stored, carried or moved from one location to another.

It would be a benefit to have a garden tool and accessory transport and storage system that could be small, organized, and easy to transport. It would also be a benefit to have a system that makes it easy to store and transport larger garden tools and accessories, including those using long handles.

BRIEF SUMMARY OF THE INVENTION

The present invention, in one embodiment, is a storage and transport device comprising a case body, a case handle, and an inner portion designed to hold gardening hand tools, gardening implements, tool heads, and a tool handle wherein the tool heads are interchangeably mountable on the handle.

Another embodiment of the present invention is a storage and transportation device for garden tools comprising a case body constructed of a generally rigid material, an inner portion constructed of a porous, coated material, the inner portion located inside the case body and designed to hold gardening hand tools, gardening implements, and tool heads, a set of clasps located on the outside of the case body, and a tool handle designed to engage and disengage the clasps and used to carry the case body, wherein the tool heads may be interchangeably mounted on the handle after it is removed from the clasps.

While multiple embodiments are disclosed, still other embodiments of the present invention will become apparent to those skilled in the art from the following detailed description, wherein is shown and described only the embodiments of the invention, by way of illustration, of the best modes contemplated for carrying out the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
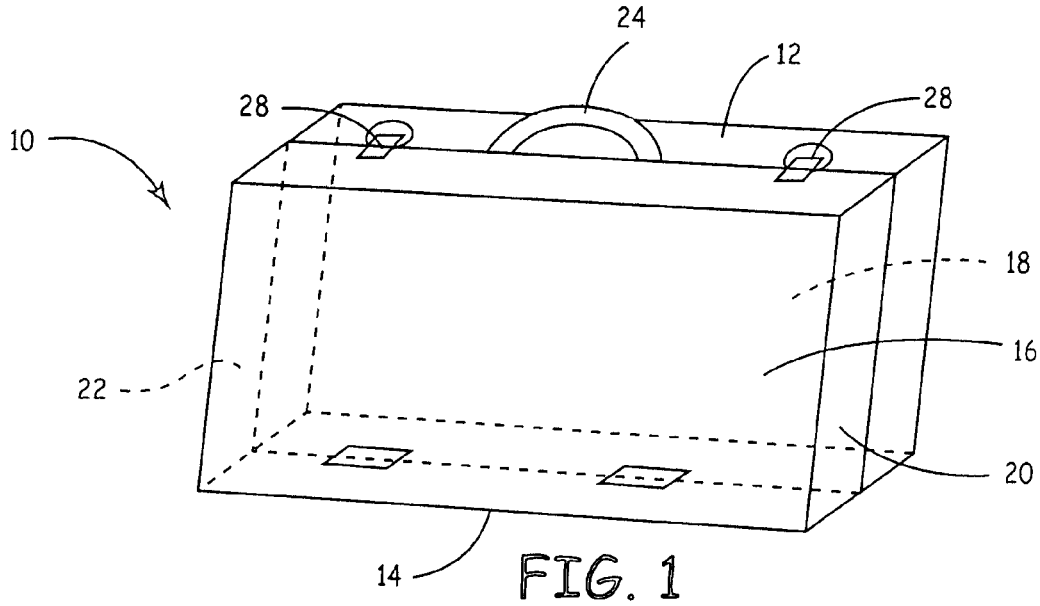
FIG. 1 is a view of one embodiment of a closed transport and storage device of the present invention.

FIG. 1 shows one embodiment of a transport and storage device according to the present invention; the device being depicted as closed. The transport and storage device 10 can have the appearance of an ordinary carrying case or suitcase, and can be constructed of any material suitable for storing and transporting garden tools and accessories, such as plastic, composite material, metal, fiberglass, or any other lightweight, strong material. In one embodiment, the device is constructed of plastic, preferably molded plastic.

In one embodiment the device 10 has a top 12, a bottom 14, a first side 16, a second side 18, a first end 20 and a second end 22. The device has a handle 24 on the top 12 that makes it easy to carry. In other embodiments, the handle can be on the first end 20, the second end 22, or the device 10 may have multiple handles on or in any combination of the ends and the top 12. The first side 16 and second side 18 are connected at the bottom 14 by a hinge mechanism 26, seen in FIG. 2, which allows the first side 16 and the second side 18 to pivot in relation to each other between a closed position, as shown in FIG. 1, and an open position, as shown in FIG. 2.

In one embodiment, the top 12 carries a latching and receiving mechanism 28, so that when the two sides are brought together, they can be releasably connected and/or locked together to hold the device closed, as shown in FIG. 1. The latching and receiving mechanisms can be on either side of the handle as shown in FIG. 1, or can be arranged in any other configuration which facilitates opening and closing of the device 10.

Figure 2:
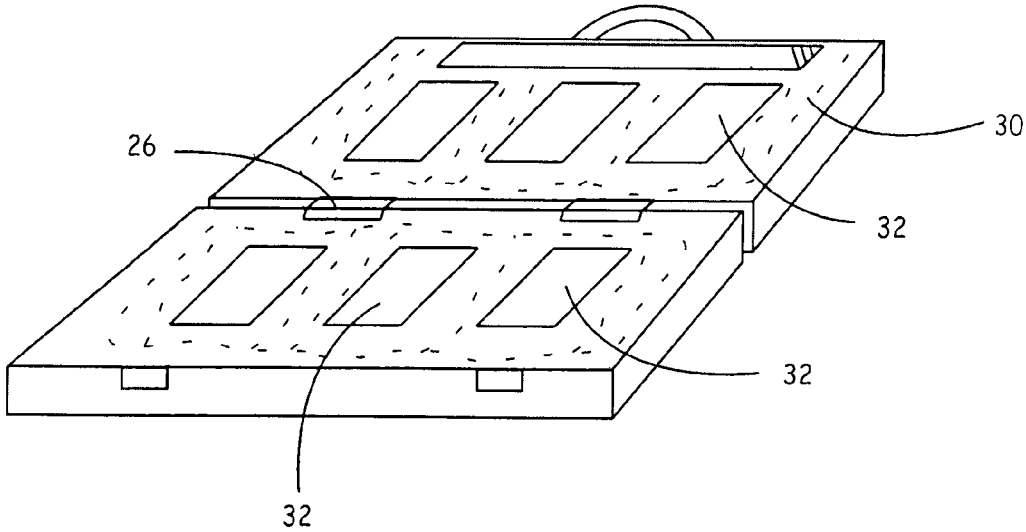
FIG. 2 is a view of one embodiment of an open transport and storage device of the present invention.

FIG. 2 shows an embodiment of the transport and storing device in an open position. As shown in this embodiment, the interior of the device 10 may have an inner portion 30 having holding areas 32 designed to "nest" or hold the different gardening tools and implements. The inner portion 30 can be made of any material suitable for the purpose of supporting the storage and transportation of garden tools and implements. Some suitable materials include plastics, foam rubbers, metals and Styrofoam. Of course one of skill in the art will recognize that any type of material suitable for the purpose described can be used. In one embodiment, the inner portion 30 is molded plastic with the holding areas 32 relieved or shaped specifically to conform to support and tightly receive certain tools or tool components, such as hand rakes, shovel heads, pruning shears, a handle that is designed to be interchangeably connected to large tool heads, or any combination of garden tools and accessories desired to be stored in the carrying case. In another embodiment, the device has no inner portion 30 and the different gardening tools and implements are supported inside the carrying case with ties or clasps attached to the inner surfaces of the case 10. In yet another embodiment, the inner portion 30 is made of a porous material that allows water to drain away from the tools. This is advantageous when the tools are washed off before being placed in the case. Allowing the water to drip or drain away or off of the tools helps to prevent rusting of metal parts. An additional advantageous feature is that the inner portion 30 has or is impregnated with an oil or rust protectant coating to further assist in the prevention of rusting of metal parts. This may be done by applying a layer of an absorbent material, such as felt or artificial chamois or thin sponge to certain areas. Such areas can then have a light grade oil or other protective lubricant or rust protectant such as Rust-Fighter™ by 3M Corporation, St. Paul, Minn. or Bull Frog™ from Action Electronics Wholesale Company, Santa Ana, Calif. applied to or impregnated in them.

Figure 3A:
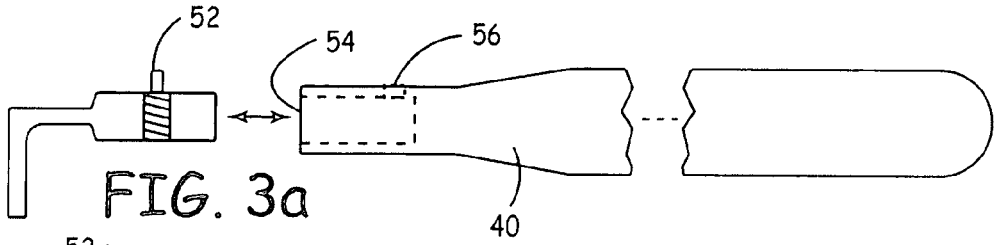
FIGS. 3*a*–3*b* are top and side views of one embodiment of a long handled tool for use with the transport and storage device of the present invention.
Figure 3B:
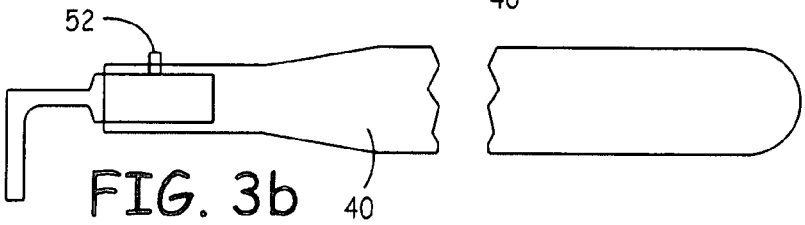

FIGS. 3*a*–3*b* show one example of a long handled tool for use with the transport and storage device of the present invention. In the present invention, a single handle 40 can be interchangeably used with different tool heads 42. For instance, the handle 40 can be attached to and used with a hoe head 42 as shown in the Figure. In the present invention, the handle 40 can be detached from the hoe head 42 and can be attached to other tool heads, such as a shovel head, a rake head, a tilling head, or any type of tool that requires a long handle to operate.

Figure 4:
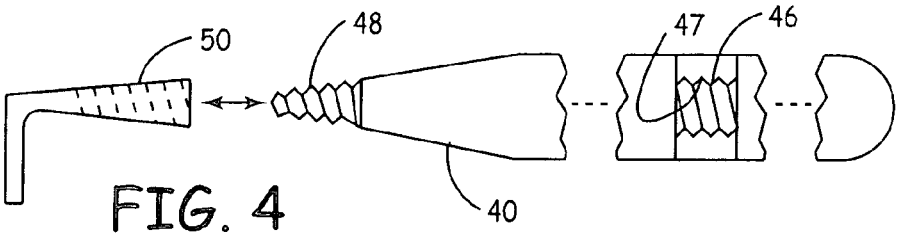
FIG. 4 is a view of another embodiment of a long handled tool for use with the transport and storage device of the present invention.
Figure 5A:
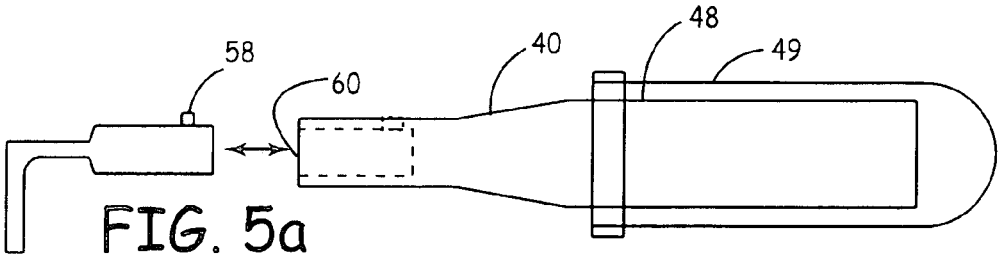
FIGS. 5*a* and 5*b* are top and side views of another embodiment of a long handled tool for use with the transport and storage device of the present invention.
Figure 5B:
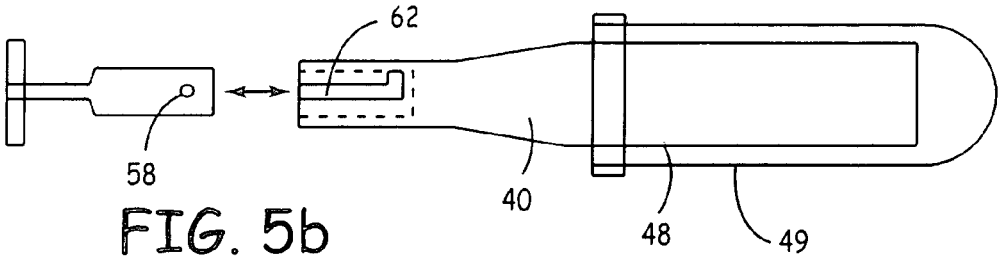
Figure 6:
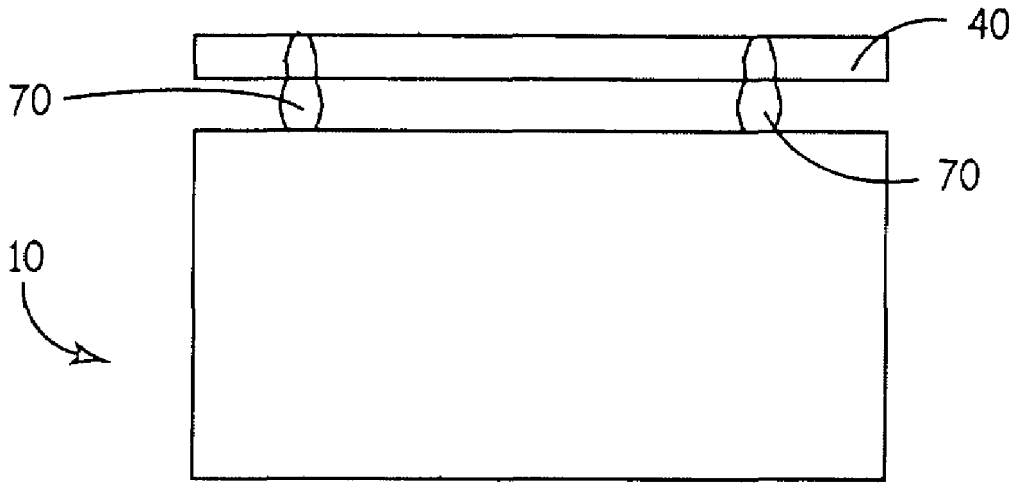
FIG. 6 is a view of one embodiment of a transport and storage device of the present invention utilizing the interchangeable tool handle as a case handle.
Figure 7C:
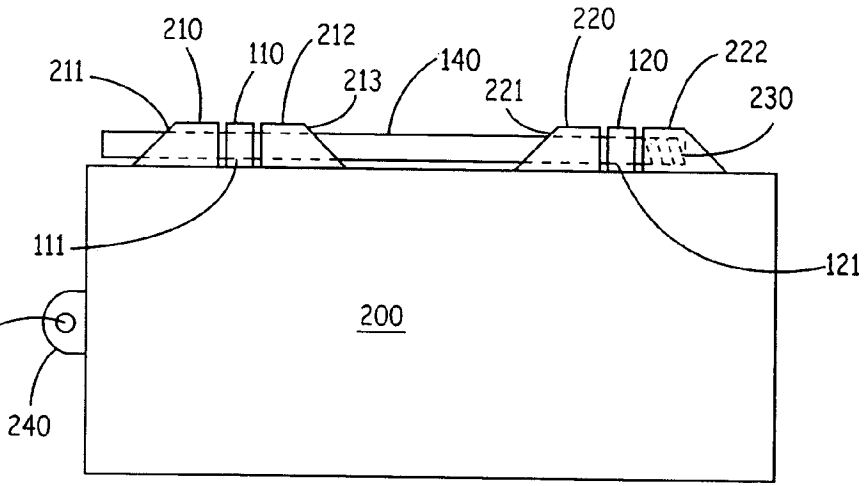
FIGS. 7*a*–7*d* show closed end, open end, side and top views respectively of another embodiment of the transport and storage device of the present invention utilizing the interchangeable tool handle as a case handle.
Figure 7D:
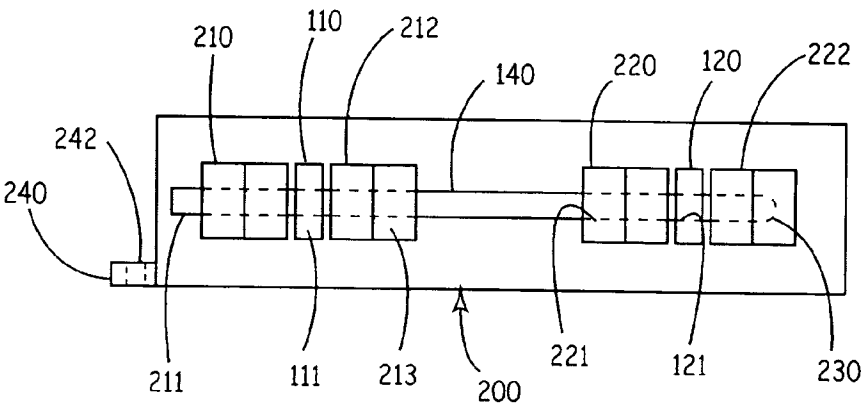
Figure 7B:
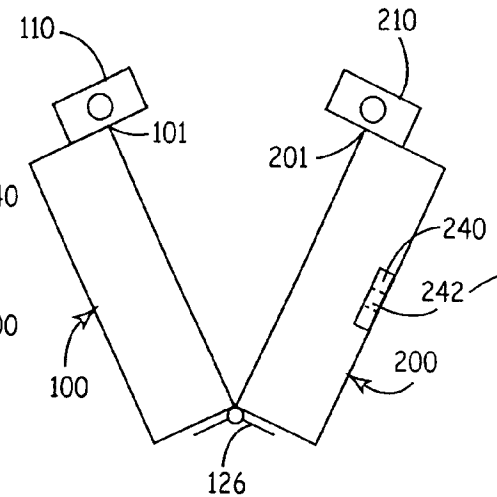
Figure 7A:
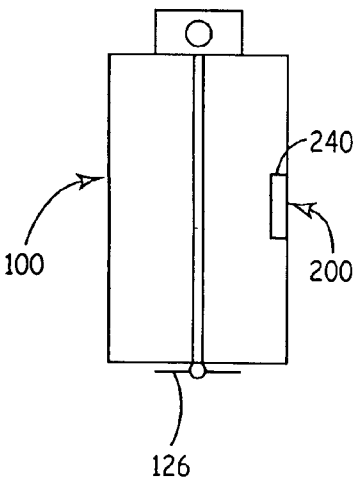
Figure 8C:
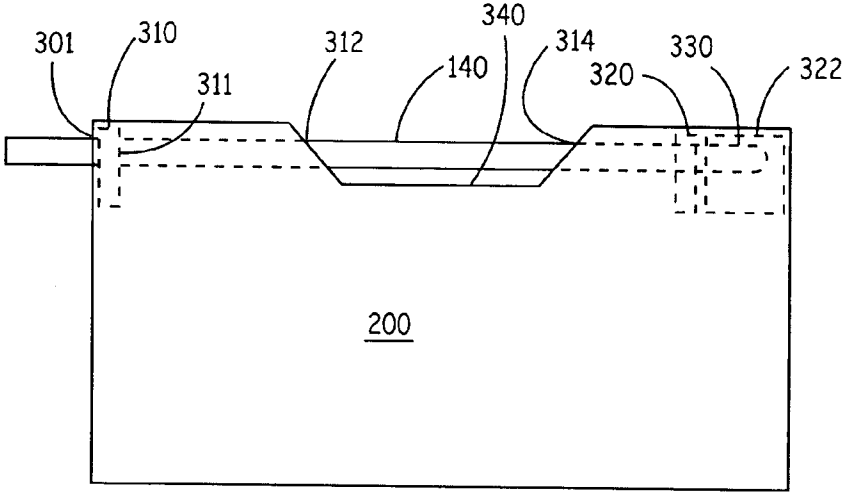
FIGS. 8*a*–8*d* show closed end, open end, side and top views respectively of a further embodiment of the transport and storage device of the present invention utilizing the interchangeable tool handle as a case handle.
Figure 8D:
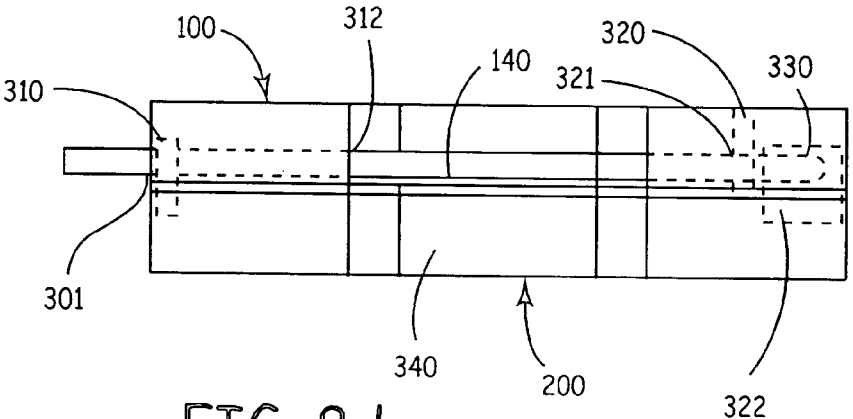
Figure 8B:
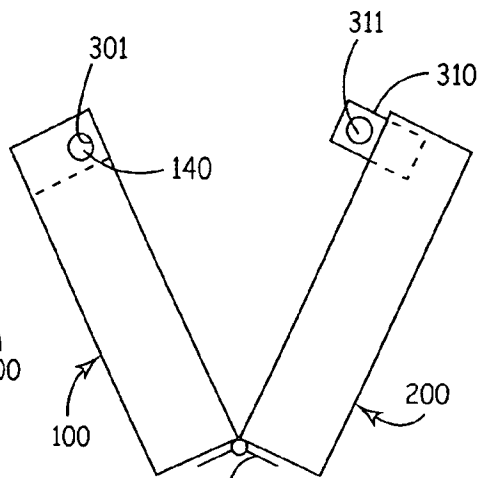
Figure 8A:
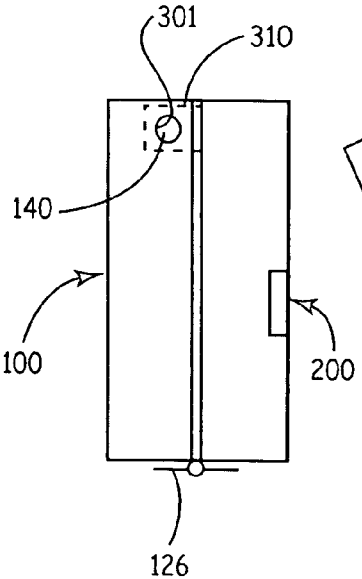

The handle 40 and tool head 42 can be attached in a number of ways. In one embodiment, as shown in FIG. 4, the tool head 42 and the handle 40 are designed to be attached via a threaded connection with the tool head 42 having a male threaded portion 50 and the handle 40 having a female threaded portion 48, or vice versa. In another embodiment, the connection is a friction fit connection. In another embodiment, such as that shown in FIGS. 3*a*–3*b*, the connection is a locking pin connection. In this embodiment, the tool head 42 has a spring loaded pin 52 and the handle 40 has a hollow opening 54 with a locking portion 56 through which the pin extends, holding the head 42 on the handle 40. Of course, this arrangement may be reversed, with the tool head 42 having the hollow opening and the handle carrying the spring loaded pin. In yet another embodiment, as shown in FIG. 5, instead of a spring loaded pin, the tool head 42 can carry a static pin 58 and the handle 40 can have a hollow opening 60 with a path 62 cut into the handle 40 for the pin 58 to follow, whereby the path 62 is designed so that as the pin 58 follows the path, the handle 40 or tool head 42 can be twisted so as to lock and/or friction fit the pin 58 into place. This embodiment can have a spring in the handle to force the static pin 58 into a portion of the path whereby it substantially holds the pin 58 in place.

The handle 40 that is used with the different tool heads can also be carried in the case 10. In one embodiment, the handle 40 is a two piece handle, whereby the two pieces are connected to each other by a suitable connection means, such as mating threaded connectors (see 46, 47, FIG. 4), friction fit or a locking pin connector in order to form the handle to be used with the various tool heads. In this embodiment, the two handle pieces may be of generally equal length. In another embodiment, the handle 40 is designed in two parts 48, 49 (see FIGS. 5*a*, 5*b*) to be telescoped in order to be collapsed into a shorter piece that can be stored in the carrying case 10. A fastening ring can be used to secure the parts 48, 49 in extended or collapsed position. The advantage of having the handle reduceable to two smaller pieces or shortened to a shorter length, is that it can then be stored in the carrying case 10 with the other gardening tools and implements, and it takes up less room.

FIG. 5 is a view of another embodiment of the transport and storage device of the present invention using the handle 40 as part of the case 10. In this embodiment, instead of a customary case handle 24, the case carries one or more clasps 70, and the handle 40 connects to the clasps 70 and is used to carry the case 10. The clasps 70 can be any type of connection device that can easily be carried on the case 10 and can engage and disengage from the handle 40 in a manner that allows the case 10 to be carried. In one embodiment, the clasps can be semi-rigid C-clasps affixed to the case that allow the handle 40 to snap in place when a certain force has been overcome, and hold the handle 40 in place. In another embodiment, the clasps 70 can be flexible loops, for example hook and loop closures such as VELCRO closures or buckle type devices that make it easy to engage and disengage the handle 40 and allow the case 10 to be carried by the handle 40.

FIGS. 7*a*–7*d* show a case with a particular variation of the foregoing clasps, which make it unnecessary to have a case latching mechanism. In this embodiment, the case has two halves 100, 200 connected by hinge mechanism 126. The clasps for handle 140 (which is for use as a handle with the enclosed tool components; thus, the case handle adds no additional weight to the toolkit) are made from interleaving projections from each top mating edge 101, 201 of the respective halves 100, 200. At one end of the case, from edge 101 extends projection 110 that interleaves between corresponding projections 210 and 212 extending from edge 201. At the other end of the case, from edge 101 extends projection 120 that interleaves between corresponding projections 220 and 222 extending from edge 201. Projections 210, 110 and 212 have aligned openings 211, 111 and 213 respectively passing through them to permit insertion of handle 140. Projections 220 and 120 also have openings 221 and 121 respectively passing through them to permit insertion of handle 140. Projection 222 has an internal connection structure 230 to mate with and grasp the inserted end of handle 140. The connection structure 230 may be any one of the handle connection arrangements discussed above, but should correspond to the one used to connect the handle 140 to the tool heads enclosed within the case. Thus, the connection end of handle 140 is both used and protected by its enclosure and capture within projection 230. To permit the case to be hung easily on a wall, one end of case half 200 can have a projecting ear 240 with an opening 242 for receiving a wall hook.

FIGS. 8*a*–8*d* show a case with a further variation of the foregoing clasps, where they are associated with the interior of the case. In this embodiment, the case again has two halves 100, 200 connected by hinge mechanism 126 forming the case body. The clasps for handle 140 (which is for use as a handle with the enclosed tool components) are made from orifices and internal projections from one of the respective halves 100 or 200 into the other half 200 or 100. At one end of the case, from case half 200 extends a projection 310 that has orifice 311. The case end wall on the other half 100 has an orifice 301. Projection 310 extends into case half 100 when the case is closed, such that orifices 301 and 311 are aligned and handle 140 can be inserted through them into the case. At the other end of the case, from case half 100 extends projection 320 with an orifice 321 passing through it to permit insertion of handle 140. From case half 200 extends a projection 322. Projection 322 has an internal connection structure 330 to mate with and grasp the inserted end of handle 140. The connection structure 330 may be any one of the handle connection arrangements discussed above, but should correspond to the one used to connect the handle 140 to the one or more heads enclosed within the case. The center of both halves of the upper side of the case has a recess 340 with orifices 312 and 314 aligned with orifices 301, 311 and 321 and leading into the interior of the case. When the handle 140 is inserted through orifice 301 into the case and through the orifice 311 in projection 310, it can then extend outside the case at orifice 312 to provide a graspable case handle. The handle 140 then passes back into the case at orifice 314 and passes through an orifice 321 in projection 320 that extends from case half 100. The end of the handle is then received and secured in internal connection structure 330.

Although the present invention has been described with reference to preferred embodiments, persons skilled in the art will recognize that changes may be made in form and detail without departing from the spirit and scope of the invention.

I claim:

1. A storage and transport device for garden tools comprising:

a case body constructed of a generally rigid material;

an inner portion adapted to hold at least one gardening hand tool, at least one gardening implement, and at least one gardening tool head;

a set of clasps associated with the case body, a first clasp of the set positioned adjacent a first end of the case body and a second clasp of the set positioned adjacent a second end of the case body, whereby the clasps comprise opposed, interleaved clasps extending inwardly from two case halves joined at a hinge and forming the case body; and an elongated gardening tool handle designed to extend between and engage and disengage with the clasps and used to carry the case body, wherein the at least one gardening tool head is designed to be mounted selectively on the gardening tool handle.

2. The device of claim 1, wherein the tool handle is comprised of two telescoping sections.

3. The device of claim 1, wherein the inner portion is molded plastic with holding portions shaped to hold one or more items selected from the group comprising gardening hand tools, gardening implements, gardening tool heads and the tool handle for operable connection to tool heads.

4. The device of claim 1, wherein the inner portion is resilient foam with holding portions shaped to hold one or more items selected from the group comprising gardening hand tools, gardening implements, gardening tool heads and the tool handle for operable connection to tool heads.

5. The device of claim 1, wherein the at least one gardening tool head and the gardening tool handle are designed to engage and disengage via a locking pin connection.

6. The device of claim 1 wherein the inner portion is constructed of a porous, protectively coated material, the inner portion located inside the case body.

7. The device of claim 1 wherein the inner portion is constructed of a porous, oil coated material, the inner portion located inside the case body.

8. The device of claim 1 wherein the inner portion is constructed of a porous, material carrying rust protectant, the inner portion located inside the case body.

9. The device of claim 1 wherein the inner portion is constructed of a material impregnated with oil, the inner portion located inside the case body.

10. A storage and transport device for garden tools comprising:

a case body constructed of a generally rigid material;

an inner portion adapted to hold at least one gardening hand tool, at least one gardening implement, and at least one gardening tool head;

a set of clasps associated with the case body, the clasps extending outwardly from the edges of two case halves joined at a hinge and forming the case body; and a gardening tool handle designed to engage and disengage with the clasps and used to carry the case body, wherein the at least one gardening tool head is designed to be mounted selectively on the gardening tool handle, the gardening tool handle passing through at least one clasp and having a releasable attachment to at least one other clasp, wherein the releasable attachment is the same as used for mounting the at least one gardening tool head.

11. A storage and transport device for garden tools comprising:

a case body constructed of a generally rigid material;

an inner portion adapted to hold at least one gardening hand tool, at least one gardening implement, and at least one gardening tool head;

a set of clasps associated with the case body, the clasps comprising opposed, interleaved clasps extending outwardly from two case halves joined at a hinge and forming the case body; and a gardening tool handle designed to engage and disengage with the clasps and used to carry the case body, wherein the at least one gardening tool head is designed to be mounted selectively on the gardening tool handle, the gardening tool handle passing through at least one clasp and having a releasable attachment to at least one other clasp wherein the releasable attachment is the same as used for mounting the at least one gardening tool head.

12. The device of claim 11, whereby the releasable attachment is a threaded connection used to attach to the at least one gardening tool head.

13. The device of claim 11, wherein the inner portion is constructed of a porous, protectively coated material, the inner portion located inside the case body.

14. The device of claim 11, wherein the tool handle is comprised of two telescoping sections.

15. The device of claim 11, wherein the inner portion is molded plastic with holding portions shaped to hold one or more items selected from the group comprising gardening hand tools, gardening implements, gardening tool heads and the tool handle for operable connection to tool heads.

16. The device of claim 11, wherein the inner portion is resilient foam with holding portions shaped to hold one or more items selected from the group comprising gardening hand tools, gardening implements, gardening tool heads and the tool handle for operable connection to tool heads.

* * * * *